US010337224B1

(12) United States Patent
Shah

(10) Patent No.: US 10,337,224 B1
(45) Date of Patent: Jul. 2, 2019

(54) GEARED HINGE WITH REMOVABLE ACCESS PANEL

(71) Applicant: ARCHITECTURAL BUILDERS HARDWARE MFG., INC., Itasca, IL (US)

(72) Inventor: Ankit Shah, South Barrington, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 0 days.

(21) Appl. No.: 15/860,979

(22) Filed: Jan. 3, 2018

(51) Int. Cl.
*E05D 11/00* (2006.01)
*E05D 3/12* (2006.01)

(52) U.S. Cl.
CPC ..... *E05D 11/0081* (2013.01); *E05D 3/122* (2013.01); *E05Y 2400/654* (2013.01); *E05Y 2900/132* (2013.01); *Y10T 16/541* (2015.01)

(58) Field of Classification Search
CPC ..... E05D 3/122; E05D 11/0081; E05D 7/009; B66B 13/125; Y10T 16/541; Y10T 16/558; Y10T 16/533
See application file for complete search history.

(56) References Cited

U.S. PATENT DOCUMENTS 3,402,422 A * 9/1968 Baer ..... E05D 3/122 16/354
3,428,738 A * 2/1969 Zychal ..... E05D 11/0081 16/221
3,838,234 A 9/1974 Peterson
3,842,386 A 10/1974 Suska
4,140,357 A 2/1979 Wolz et al.
4,412,711 A 11/1983 Suska
4,606,394 A 8/1986 Bannister
5,062,181 A 11/1991 Bobbowski et al.
5,201,902 A * 4/1993 Baer ..... E05D 1/04 16/273
5,337,451 A 8/1994 Goossens
RE35,618 E 10/1997 Goossens
5,685,045 A 11/1997 Lace
5,727,960 A 3/1998 Zehrung
5,991,975 A * 11/1999 Baer ..... E05D 7/009 16/250
6,170,210 B1 1/2001 Marts
6,223,393 B1 * 5/2001 Knopf ..... G06F 1/1618 16/366

(Continued)

*Primary Examiner* — Jeffrey O'Brien
(74) *Attorney, Agent, or Firm* — Greer, Burns & Crain, Ltd.

(57) ABSTRACT

A door hinge includes first and second leaves each with a plate portion, a free edge and an opposite geared edge, the geared edges meshing with each other as the leaves operationally pivot. Each leaf has a front surface and an opposite back surface. A cap covers the meshed geared edges on the back surface and defines a pivot axis for each of the leaves, the cap defining a channel A recess is provided in the front surface of each leaf, the recesses being in communication with the channel, each recess defining a break in the geared edges. First and second access panels are removably secured in the recesses, having a geared panel edge complementary with the leaf geared edge and filling the break, and at least one of the access panels being secured to the respective hinge leaf by security fasteners extending only into the leaf.

11 Claims, 6 Drawing Sheets

(56) References Cited

U.S. PATENT DOCUMENTS

| | | | | |
|---|---|---|---|---|
| 6,735,823 | B2 | 5/2004 | Pelletier | |
| 6,928,713 | B2 | 8/2005 | Baer | |
| 7,063,042 | B2 * | 6/2006 | Dillingham | E05D 3/122 16/354 |
| 7,406,748 | B2 * | 8/2008 | Baer | E05D 3/022 16/354 |
| 7,650,670 | B2 * | 1/2010 | Baer | E05D 3/122 16/236 |
| 8,307,509 | B2 * | 11/2012 | Schau | E05D 3/122 16/250 |
| 8,517,747 | B2 | 8/2013 | Bryla et al. | |
| 8,646,206 | B2 | 2/2014 | Gilchrist | |
| 9,290,974 | B2 * | 3/2016 | Alexander | E05D 3/122 |
| 9,297,190 | B2 * | 3/2016 | Lee | E05D 3/122 |
| 9,428,946 | B2 * | 8/2016 | Martinez Garcia | E05D 3/122 |
| 10,030,422 | B2 * | 7/2018 | Lee | E05D 7/04 |
| 2005/0091797 | A1 * | 5/2005 | Dillingham | E05D 3/122 16/354 |
| 2008/0282502 | A1 * | 11/2008 | Lenze | E05D 3/12 16/223 |
| 2011/0283624 | A1 | 11/2011 | Baer | |
| 2014/0077618 | A1 | 3/2014 | Herglotz et al. | |

* cited by examiner

GEARED HINGE WITH REMOVABLE ACCESS PANEL

BACKGROUND

The present invention relates generally to hinges, and more specifically to geared hinges or continuous gear hinges having internal electrical wiring channels.

Continuous gear hinges tolerate considerably more abuse than more traditional knuckle hinges, and for that reason are found on doors which see substantial use, such as those at the main entrances to schools and public buildings, often as replacements for knuckle hinges. Continuous gear hinges are also employed in doorways of medical care facilities, including hospitals, clinics, rehabilitation centers, nursing homes and the like. The typical gear hinge has two leaves, each provided with a gear segment. Gear segments of each leaf mesh together and allow relative rotation that accommodates opening and closing of the door, while being held together with a cap that extends over and behind them. One of the hinge leaves is attached to the door that the hinge supports, while the other is secured to the hinge jamb of the door frame out of which the door opens. Both leaves extend the full length of the door, thus providing multiple locations at which to attach the hinge to the door and hinge jamb.

On the contrary, more traditional knuckle-type hinges secure the door to the hinge jamb at small isolated areas, and may pull away from one or the other or both, particularly when used on doors that see heavy or abusive use. Also, knuckle-type hinges, as well as some types of continuous geared hinges, have been found to create a point of support for cords or pieces of clothing used by medical patients to injure themselves.

In newer commercial and institutional construction, as well as in rehabbed spaces, doors often carry electrically-operated appliances such as locks or sensors. Such appliances require electrical service in the doors themselves, including those doors with continuous gear hinges. It is known to provide electricity through knuckle hinges. In this regard, see U.S. Pat. Nos. 3,838,234; 3,842,386; and 4,412,711. However, continuous gear hinges have seen little innovation in this respect. Relevant references are U.S. Pat. Nos. 8,307,509 and 7,063,042. There is a need for a more efficient geared hinge structure that accommodates internal wiring.

SUMMARY

The above-listed need is met or exceeded by the present geared hinge, which features removable access panels for installing wiring post-installation of the hinge, door and door frame. In the present hinge, the removable access panels are secured in place using security fasteners, which do not extend into the door frame and as such are not needed for securing the hinge to the door and/or the door frame. Also, the security fasteners require a specialized tool for removal, and as such are more difficult to remove by unauthorized individuals.

Another feature of the present hinge is that the hinge leaves supporting the removable access panels have a recess defining a cavity or space for the insertion and accommodation of electrical conductors such as multi-lead cables. The cavity is further enhanced by providing undercuts in interior surfaces of the access panels themselves. Thus, upon assembly, the access panel and the underlying hinge portion cooperate to define an electrical conductor space.

Still another feature of the present hinge is that the present access panels are dimensioned to fit between adjacent polymeric bearings used for supporting the movement of the respective hinge leaves. This relatively smaller dimension of the panels allows for the use of smaller fasteners than employed by conventional units.

More specifically, the present hinge is configured for pivotably mounting a door in a door frame, and includes a first leaf having a first plate portion, a first free edge and an opposite first geared edge, a second leaf having a second plate portion, a second free edge and a second geared edge, the first and second geared edges constructed and arranged to mesh with each other as the first leaf is pivoted axially relative to the second leaf, the first and second leaves having a front surface, and an opposite back surface facing at least one of the door and the door frame upon which the hinge is mounted. A cap is configured for covering the meshed first and second geared edges on the back surface and defines a pivot axis for each of the first and second leaves, the cap defining a channel A first recess is provided in the front surface of the first leaf and a complementary second recess is provided in the front surface of the second leaf, the recesses being in communication with the channel, each first and second recess defining a break in the first and second geared edges. A first access panel is removably secured in the first recess, having a first geared panel edge complementary with the first geared edge and filling the break, a second access panel is removably secured in the second recess, having a second geared panel edge complementary with the first geared edge and filling the break, and at least one of the first and second access panels being secured to the respective hinge leaf by security fasteners extending only into the leaf.

A feature of the present hinge is that a cavity is defined in the floor of the first and second recess for accommodating the insertion of an electrical conductor, preferably a multi-lead ribbon cable or the like, however individual strands of wire are also contemplated. Additional conductor space is defined within the hinge for accommodating the electrical conductor through the provision of undercuts in at least one and preferably both of the access panels. Upon installation of the access panels, the conductor space is defined in part by the cavities, and in part by the undercuts. In addition, conductor openings are provided in each of the first and second leaves, and the openings are preferably located in the recesses.

Another feature of the present hinge is that a plurality of axially spaced gaps is provided in the geared edges of the first and second leaves, and a bearing block is located in each gap. In the preferred embodiment, peripheral margins of the first and second access panels are located between adjacent, axially spaced bearing blocks. Also, the panels are secured to the respective hinge leaves by panel fasteners passing through panel fastener openings in the first and second recesses, the panel fastener openings having a smaller diameter than that of mounting holes used to secure the hinge to the door and the door frame.

In another embodiment, a hinge is provided that is configured for pivotably mounting a door in a door frame, and includes first and second leaves each with a plate portion, a free edge and an opposite geared edge, the geared edges meshing with each other as the leaves operationally pivot. Each leaf has a front surface and an opposite back surface, a cap covers the meshed geared edges on the back surface and defines a pivot axis for each leaf, cap defining a channel A recess is provided in the front surface of each leaf, the recesses being in communication with the channel, each recess defining a break in the geared edges. First and second access panels are removably secured in the recesses, having a geared panel edge complementary with the leaf geared edge and filling the break. At least one of the access panels is secured to the respective hinge leaf by security fasteners extending only into the leaf Each recess defining a cavity, and each access panel defining an undercut in an inner wall, the cavity and the undercuts being aligned and defining an electrical conductor space for accommodating an electrical conductor.

DETAILED DESCRIPTION

Figure 1:
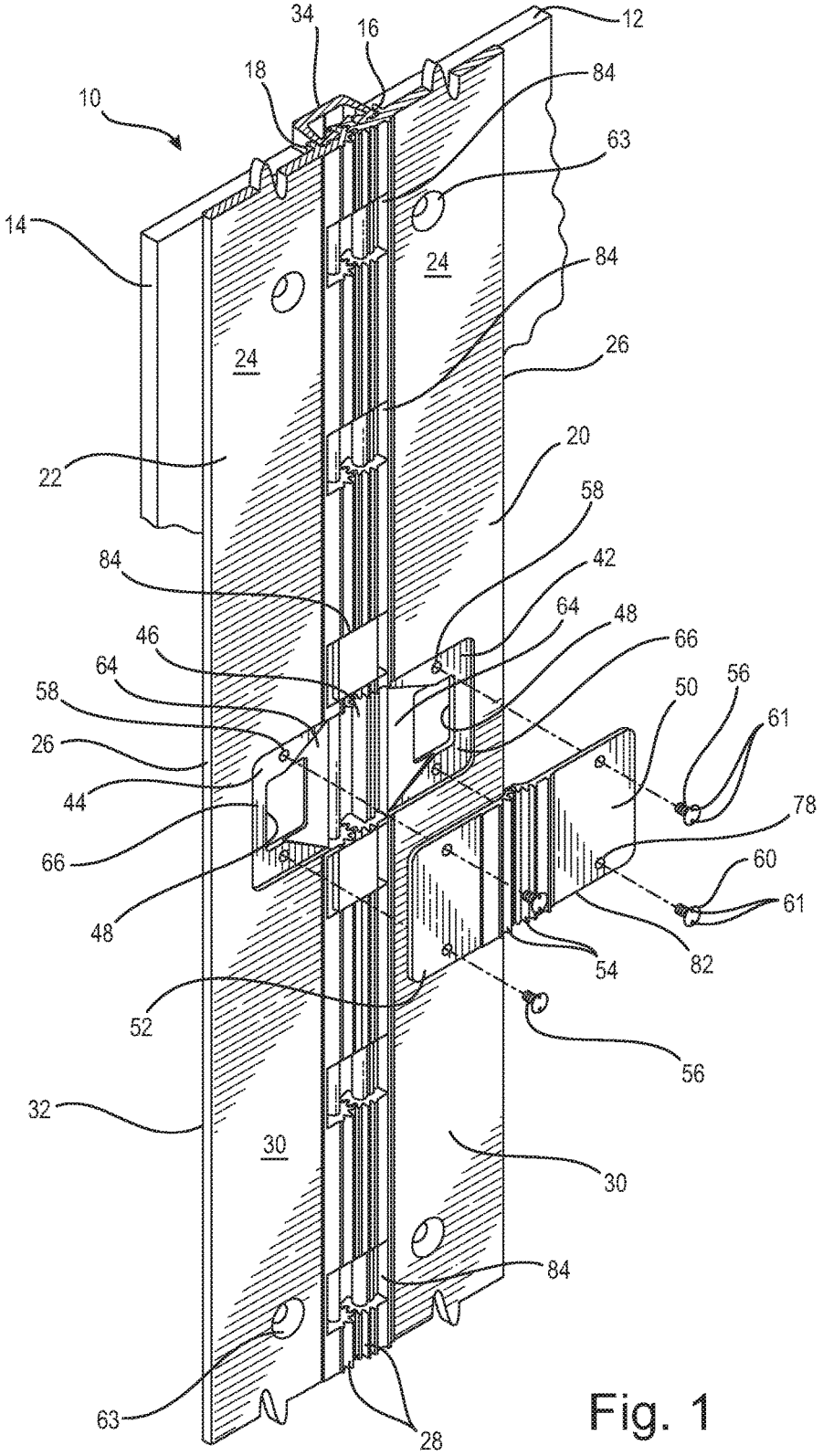
FIG. 1 is a fragmentary, exploded front perspective view of the present hinge.
Figure 10:
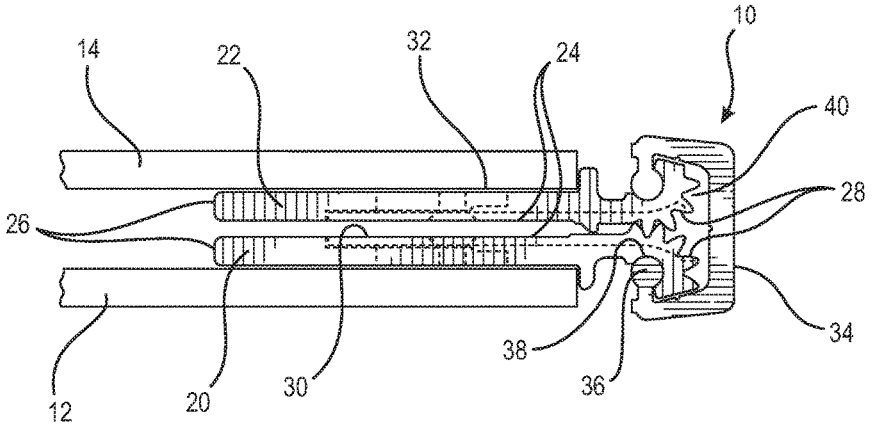
FIG. 10 is an overhead plan view of the present hinge in a closed position.

Referring now to FIGS. 1 and 10, the present hinge is generally designated 10 and is constructed and arranged for mounting to a door 12 that is configured for operational engagement in a surrounding door frame 14, as is well known in the art, which includes a pair of spaced vertical members or jambs, joined together by an upper horizontal member or lintel (frame details not shown). According to conventional practice, the hinge 10 is mounted between complementary edges 16 of the door 12 and edge 18 one of the jambs of the door frame 14.

More specifically, the present door hinge 10 is a continuous gear hinge, and extends axially or vertically the full length of the door 12. Included on the hinge 10 is a first or hinge leaf 20, and a second or jamb leaf 22. Each of the first and second leaves 20, 22 is a mirror image of the other, and so the following general explanation will relate to one leaf to simplify matters.

Referring now to FIGS. 1, and 4-6, each of the leaves 20, 22 has a plate portion 24 with a free edge 26 and an opposite geared edge 28. As is known in the art, the first and second geared edges 28 mesh with each other as the door 12 is pivotably moved in the frame 14 between an open position and a closed position. Also, each of the leaves 20, 22 has a front surface 30 that is visible by the user or installer, and a back surface 32 that faces the door 12 or the door frame 14.

Referring now to FIGS. 1, 5, 6 and 8-10, an elongate cap 34 is engaged with each of the geared edges 28 on the back surfaces 32, and both covers the meshed gear edges and accommodates the pivoting movement of the leaves 20, 22. More specifically, the cap 34 has a pair of elongate or axially-extending ribs 36, each of which engage a corresponding groove 38 in the geared edge 28 and define a pivot axis for each leaf. Also, the cap 34 defines a generally "U"-shaped channel 40 that accommodates the pivoting movement of the gear edges 28.

A feature of the present hinge 10 is that each of the first and second leaves 20, 22 has a respective recess, identified as a first recess 42 and a second recess 44, in the front surface 30 of each plate portion 24. It is preferred that the first and second recesses 42, 44 are complementary to each other, and both are in communication with the channel 40 through a break or slot 46 in the plate portion 24 in the general area of the gear edges 28. Each recess 42, 44 is provided with a conductor opening 48 that opens to the back surface 32 of the plate portion 24. In the preferred embodiment, the conductor opening 48 has a generally rectangular dimension with an area that is less than half the area of the corresponding recess 42, 44, however other configurations and dimensions are contemplated.

Referring now to FIGS. 1-3 and 7-9, first and second access panels 50, 52 are removably secured in the corresponding first and second recesses 42, 44. Each access panel 50, 52 has a respective geared panel edge 54 that is complementary with the first geared edge 28 and filling the break 46 at that location. A significant feature of the present hinge 10 is that at least one and preferably both of the first and second access panels 50, 52 are secured to the respective hinge leaves 20, 22 by security fasteners 56 extending only into the leaf and threadably engaging panel fastener openings 58. While other arrangements are contemplated, the panel fastener openings 58 are located adjacent narrow edges of the conductor openings 48.

In the present application, "security fastener" will refer to a threaded fastener having a head 60 with an atypical configuration, such that a standard slotted, Philipps, hex or TORX bit will not positively engage the head for installation or removal. While other configurations are contemplated, in the present hinge, the preferred format of the security fastener 56 has a head 60 with laterally spaced blind bores 61 (FIG. 1) engageable only by a forked bit (not shown).

Another aspect of the present hinge 10 and the use of the security fasteners 56 is that the fasteners threadably engage the leaves 20, 22 and more particularly the recesses 42, 44 but do not project past the back surface 32, and as such do not project into the door 12 or the door frame 14. Each of the leaves 20, 22 is secured to the respective portions of the door 12 and the door frame 14 using conventional fasteners such as wood screws 62 (FIG. 4) which pass through mounting holes 63 in each leaf. In the preferred embodiment, a diameter of each of the mounting holes 63 is greater than a corresponding diameter of each of the panel fastener openings 58.

As described above, in institutional facilities such as hospitals, care centers, clinics and offices where continuous gear hinges are often installed, there is a growing use of electrically-operated components such as sensors, locks and the like. These components are typically installed with wired conductors, such as multi-lead cables, individual strands of wire or the like. Installation and maintenance of these electronic components is facilitated by providing the hinge with suitable spaces for accommodating the conductors without requiring removal of the hinge or the door. However, with the use of more complicated electronics, the spaces provided in conventional hinges for conductors has often been found to be inadequate.

Figure 4:
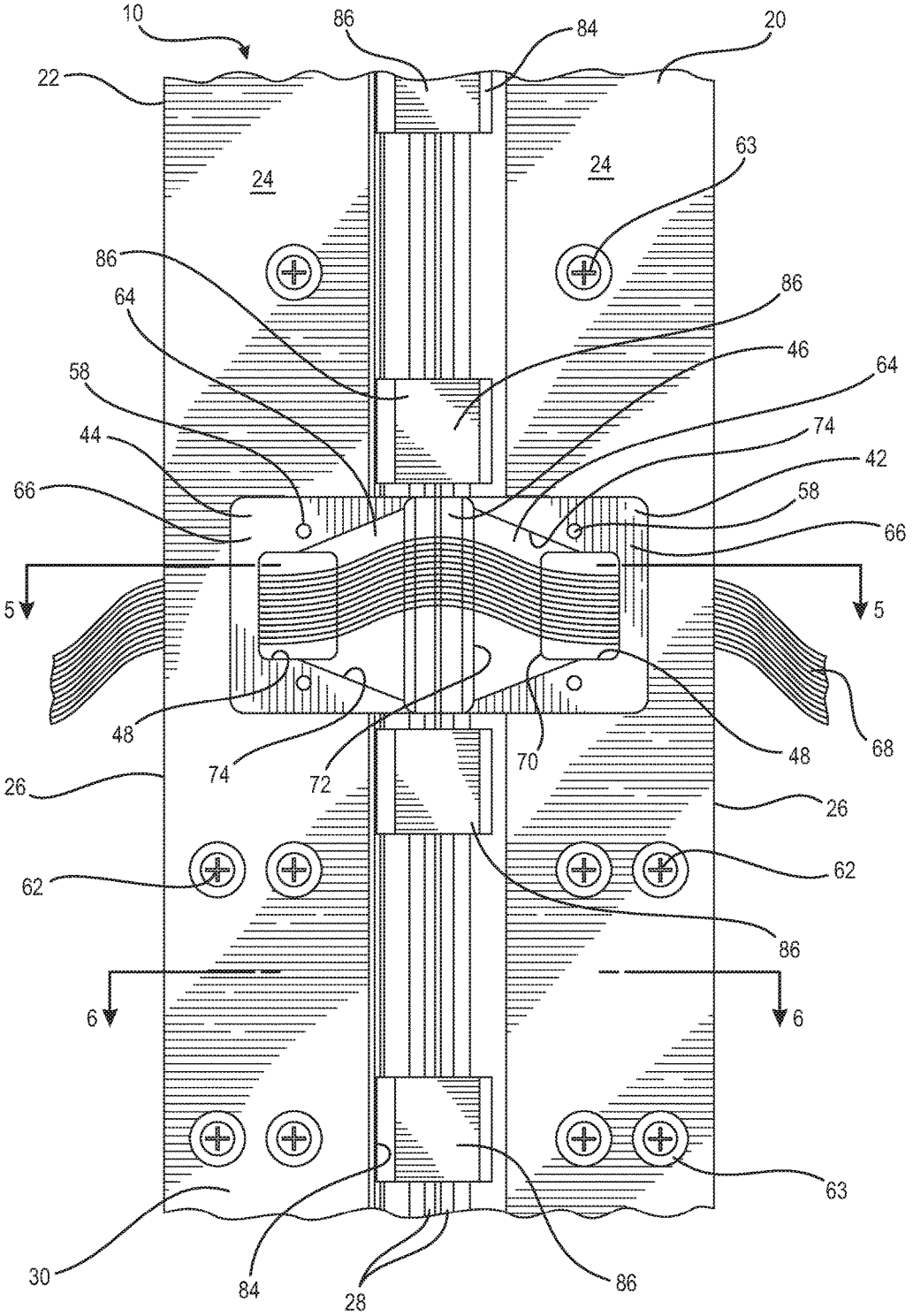
FIG. 4 is a fragmentary front view of the present hinge showing a wiring bus installed.
Figure 5:
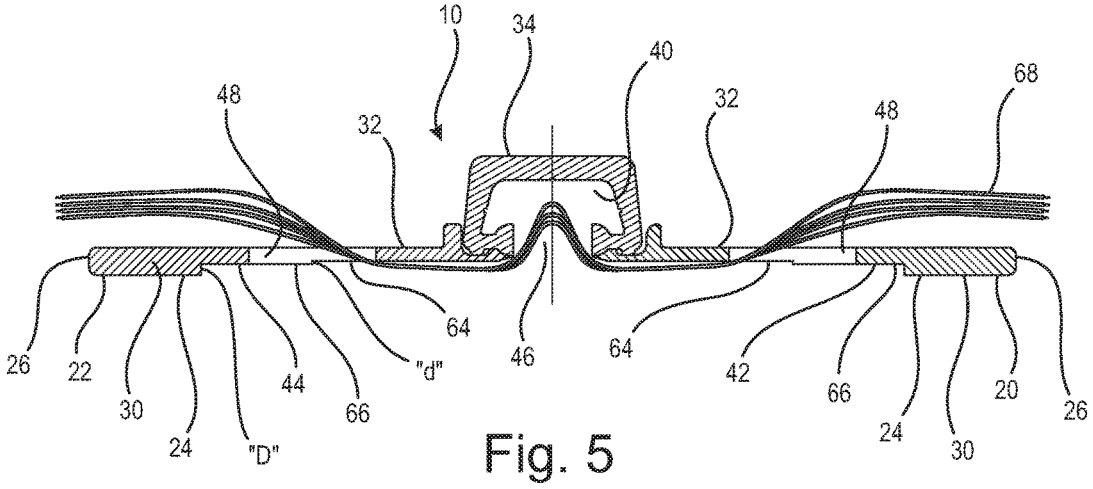
FIG. 5 is a section taken along line 5-5 of FIG. 4 and in the direction generally indicated.
Figure 6:
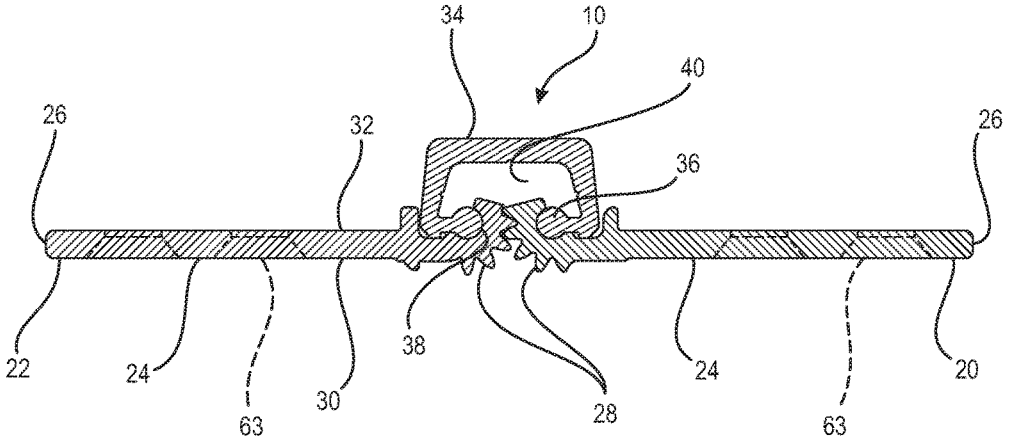
FIG. 6 is a section taken along the line 6-6 of FIG. 4 and in the direction generally indicated.
Figure 7:
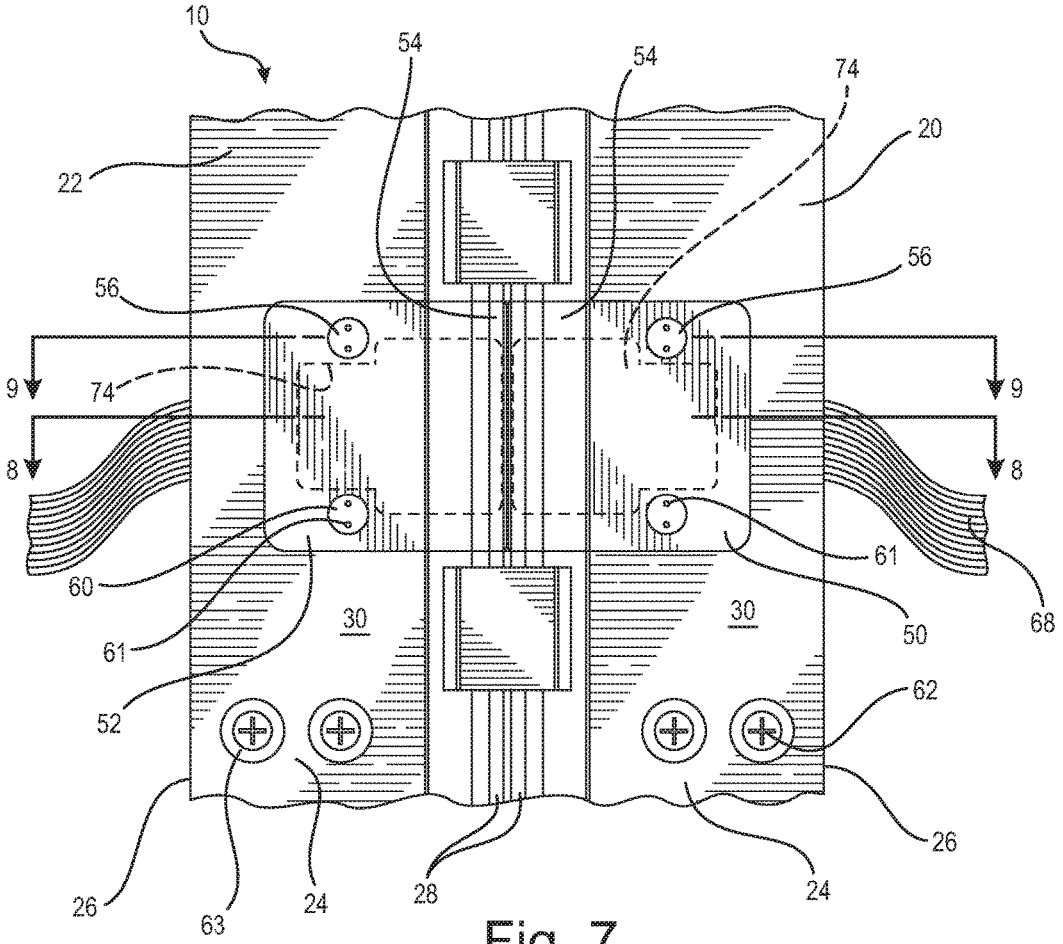
FIG. 7 is a fragmentary assembled front view of the present hinge with a wiring bus and access panels installed.

Referring now to FIGS. 1, 4, 5 and 8, in the present hinge 10, additional space for electrical conductors is provided by a cavity 64 in a floor 66 of each of the first and second recesses 42, 44 dimensioned for accommodating an electrical conductor 68, preferably a ribbon cable (FIG. 4), a plurality of strands of wire (FIG. 8) or the like as described above. As best seen in FIG. 4, while other shapes are contemplated, in the preferred embodiment, the cavity 64 is generally trapezoidal, with a short side 70 defined by the conductor opening 48, and an opposite long side 72 formed by the break or slot 46. Angled sides 74 join the short side 70 to the long side 72. Thus, in each of the recesses, 42, 44, the long sides 72 are adjacent each other, and are in communication with the break or slot 46, and also with the channel 40 defined by the cap 34. As seen in FIG. 5, the cavities 64 have a depth "d" which is less than a depth "D" of the corresponding recesses 42, 44. While other dimensions are contemplated, the preferred depth "d" is approximately 0.015 inch, while the depth "D" is 0.052 inch.

Figure 2:
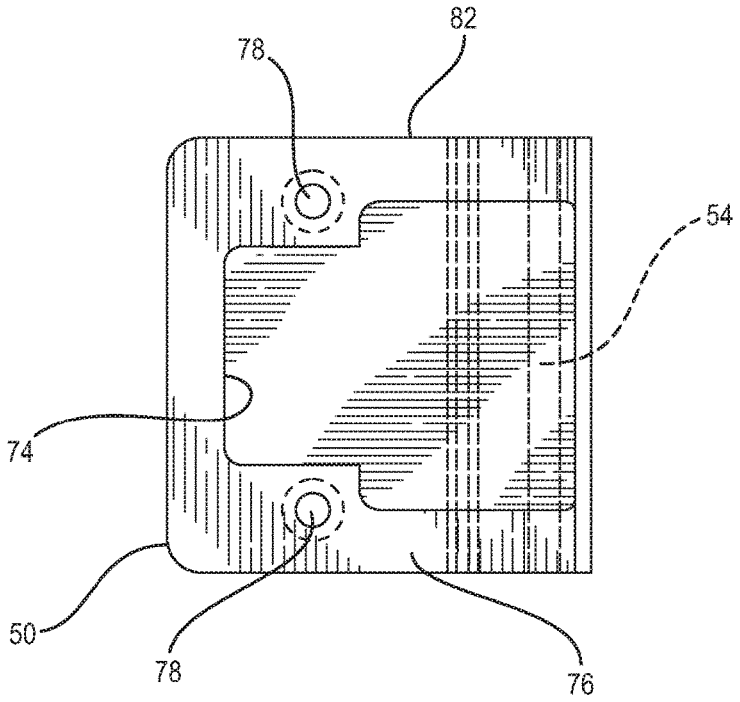
FIG. 2 is a rear elevation of one of the panels of the hinge of FIG. 1.
Figure 3:
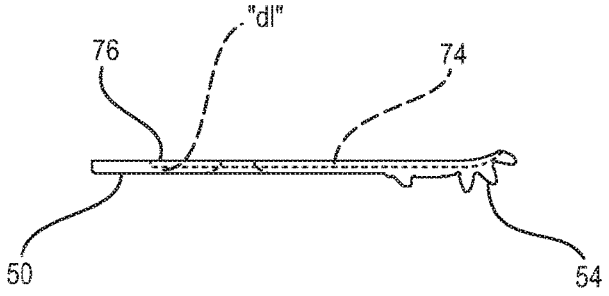
FIG. 3 is a top view of the panel of FIG. 2.
Figure 8:
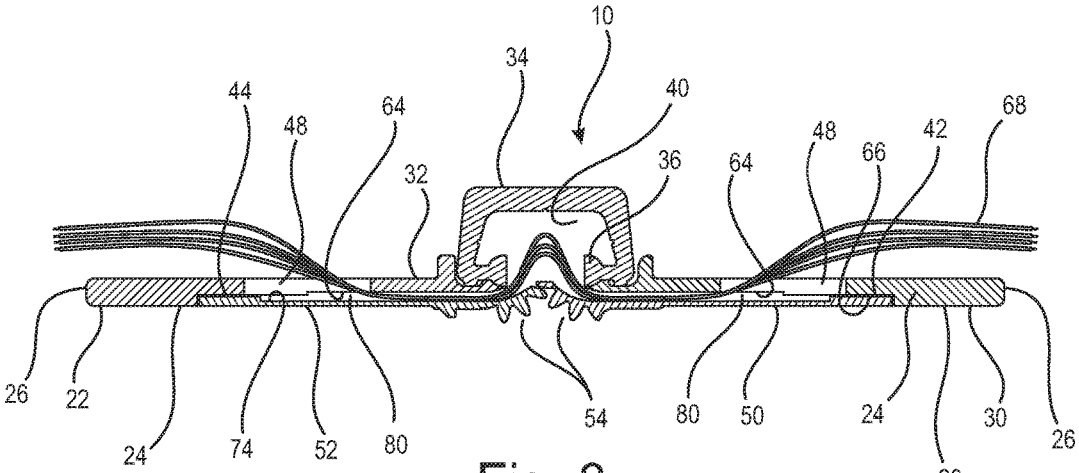
FIG. 8 is a section taken along the line 8-8 of FIG. 7 and in the direction generally indicated.
Figure 9:
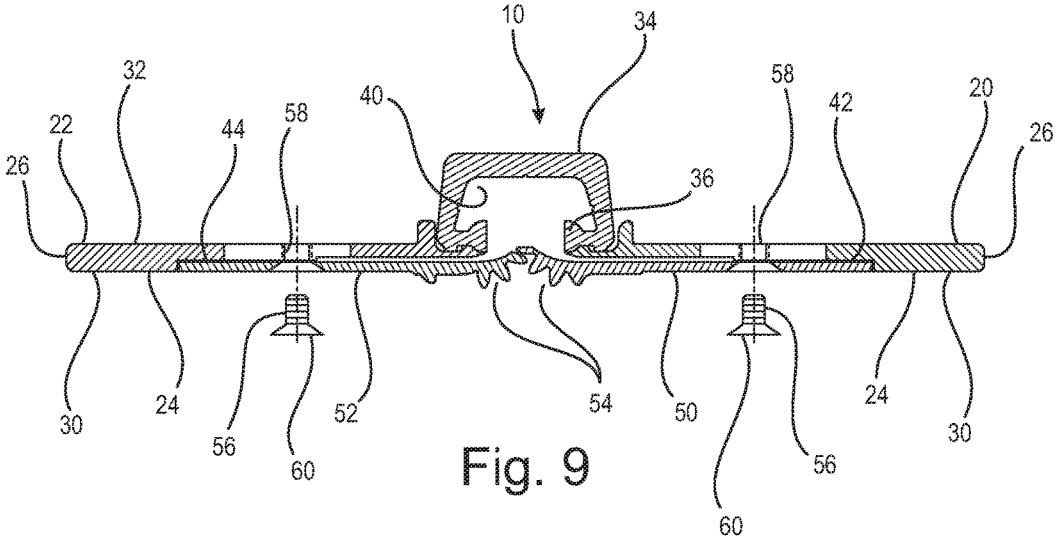
FIG. 9 is a section taken along the line 9-9 of FIG. 7 and in the direction generally indicated.

Referring now to FIGS. 2, 3 and 8, additional space is provided in the hinge 10 for the electrical conductor 68 by undercuts 74 in inner walls 76 of each of the access panels 50, 52. Again, while other dimensions are contemplated, a depth "dl" of the undercut is at least as deep as the depth "d" of the recesses 42, 44.

Also, an area of the undercut 74 occupies a majority of the inner wall 76. To accommodate a panel fastener head opening 78 in the access panels 50, 52. In addition, it is preferred that the undercuts 74 in each of the access panels 50, 52 are opposite to, and aligned with the cavities 64 in each recess 42, 44 to create a contiguous conductor space 80 (FIG. 8) which accommodates a larger variety of electrical conductors 68.

Referring now to FIGS. 1, 2, 4 and 7, another feature of the present hinge 10 is that the access panels 50, 52 each have a peripheral margin 82 which defines a generally regular polygonal shape, and particularly preferably a generally square shape, which is dimensioned to be located, and totally contained within dimensions defined by vertically or axially spaced gaps 84 in the geared edges 28. As is known in the art of such continuous geared hinges, the gaps 84 are constructed and arranged for receiving bearing blocks 86 which support the pivoting movement of the hinge leaves 20, 22 and prevent one leaf from shifting vertically relative to the other leaf. In the preferred embodiment, as well known in the art, the bearing blocks are preferably made of polymeric, reduced friction or self-lubricating materials.

Thus, it will be seen that the present hinge 10 features the use of security fasteners 56 for restricting access to the wiring of the hinge, and provides an enhanced electrical conductor space 80 defined by complementary portions of the access panels 50, 52 and the recesses 42, 44 that accommodates a wider variety of conductors than conventional hinges. By dimensioning the access panels 50, 52 to be located between adjacent bearing blocks 86, smaller panels are utilized, and correspondingly smaller security fasteners 56 are employed. Using the present access panels 50, 52 and hinge leaves 20, 22, the electrical conductor 68 is installed easily without disassembly of the hinge 10 from the door 12 and/or the frame 14.

While a particular embodiment of the present geared hinge with removable access panel has been described herein, it will be appreciated by those skilled in the art that changes and modifications may be made thereto without departing from the invention in its broader aspects and as set forth in the following claims.

The invention claimed is:

1. A hinge configured for pivotably mounting a door in a door frame, said hinge comprising:

a first leaf having a first plate portion, a first free edge and an opposite first geared edge;

a second leaf having a second plate portion, a second free edge and a second geared edge, said first and second geared edges constructed and arranged to mesh with each other as said first leaf is pivoted axially relative to said second leaf;

said first and second leaves having a front surface, and an opposite back surface facing at least one of the door and the door frame upon which said hinge is mounted;

a cap configured for covering said meshed first and second geared edges on said back surface and defining a pivot axis for each of said first and second leaves, said cap defining a channel;

a first recess in said front surface of said first leaf and a complementary second recess in said front surface of said second leaf, said recesses being in communication with said channel, each said first and second recess defining a break in said first and second geared edges;

a first access panel removably secured in said first recess, having a first geared panel edge complementary with said first geared edge and filling said break;

a second access panel removably secured in said second recess, having a second geared panel edge complementary with said first geared edge and filling said break; and at least one of said first and second access panels being secured to said respective hinge leaf by security fasteners extending only into said leaf.

2. The hinge of claim 1 further including a cavity in a floor of said first and second recesses dimensioned for accommodating an electrical conductor.

3. The hinge of claim 2 further including undercuts in said first and second access panels arranged to be opposite said cavities for defining a conductor space in each said leaf.

4. The hinge of claim 2, further including an electrical conductor provided in one of strands of wire or a ribbon format.

5. The hinge of claim 4, further including conductor openings in each of said first and second leaves located in said recesses.

6. The hinge of claim 1 further including axially spaced gaps in said first and second geared edges of said leaves, and a bearing block located in each said gap.

7. The hinge of claim 6 wherein peripheral margins of said first and second access panels are located between adjacent, axially spaced said bearing blocks.

8. The hinge of claim 1 further including panel fastener openings in said first and second recesses, and mounting holes in each of said first and second leaves for mounting said hinge to said door and said door frame, said mounting holes having a diameter larger than a corresponding diameter of said panel fastener openings.

9. A hinge configured for pivotably mounting a door in a door frame, said hinge comprising:

first and second leaves each with a plate portion, a free edge and an opposite geared edge, said geared edges meshing with each other as said leaves operationally pivot;

each leaf has a front surface and an opposite back surface;

a cap covers said meshed geared edges on said back surface and defines a pivot axis for each said leaf, said cap defining a channel;

a recess is provided in said front surface of each said leaf, said recesses being in communication with said channel, each said recess defining a break in said geared edges;

first and second access panels are removably secured in said recesses, having a geared panel edge complementary with said leaf geared edge and filling said break;

at least one of the access panels being secured to the respective hinge leaf by security fasteners extending only into the leaf; and each said recess defining a cavity, and each said access panel defining an undercut in an inner wall, said cavity and said undercuts being aligned and defining an electrical conductor space for accommodating an electrical conductor.

10. The hinge of claim 9 wherein each said cavity is generally trapezoidal in shape.

11. The hinge of claim 9 wherein said access panels each have a peripheral margin that is spaced between axially adjacent bearing blocks.

* * * * *